United States Patent [19]

Purssell et al.

[11] 4,118,610

[45] Oct. 3, 1978

[54] SNAP ACTION SWITCH BLADES

[75] Inventors: Robert F. Purssell, Plymouth; Avtar S. Bhabra, Saltash, both of England; Guglielmo Rossi, Stutensee-Friedrichstal, Fed. Rep. of Germany

[73] Assignee: Ranco Incorporated, Columbus, Ohio

[21] Appl. No.: 668,289

[22] Filed: Mar. 18, 1976

Related U.S. Application Data

[63] Continuation-in-part of Ser. No. 632,006, Nov. 14, 1975, abandoned.

[30] Foreign Application Priority Data

Nov. 16, 1974 [GB] United Kingdom ..... 49726/74
Mar. 27, 1975 [GB] United Kingdom ..... 12857/75

[51] Int. Cl.[2] ..... H01H 13/38
[52] U.S. Cl. ..... 200/67 DA; 200/275
[58] Field of Search ..... 200/67 D, 67 DA, 275

[56] References Cited

U.S. PATENT DOCUMENTS

| | | | |
|---|---|---|---|
| 2,266,537 | 12/1941 | Elmer | 200/67 DA |
| 2,299,562 | 10/1943 | Burch | 200/67 DA |
| 2,513,053 | 6/1950 | Roswell | 200/67 DA |
| 2,584,460 | 2/1952 | Jacobs, Jr. | 200/67 DA |
| 2,788,419 | 4/1957 | Young | 200/67 D |
| 3,361,888 | 1/1968 | Brackett | 200/67 DA |
| 3,967,369 | 7/1976 | Takano | 200/67 D |

FOREIGN PATENT DOCUMENTS

| | | | |
|---|---|---|---|
| 1,329,228 | 4/1963 | France | 200/67 D |
| 2,551,147 | 5/1976 | Fed. Rep. of Germany | 200/275 |

*Primary Examiner*—Samuel W. Engle
*Assistant Examiner*—Ralph Palo
*Attorney, Agent, or Firm*—Watts, Hoffmann, Fisher & Heinke Co.

[57] ABSTRACT

A snap action switch blade has a basic 'Q' shape with two arms interconnected and drawn together by a bridge portion, which may be integral with the arms, to form a deformed loop capable of snap movement between two configurations, with respective tongues projecting into and out of the loop to afford anchoring and/or actuating points for the blade.

11 Claims, 7 Drawing Figures

SNAP ACTION SWITCH BLADES

CROSS REFERENCED APPLICATION

This application is a continuation-in-part of U.S. Ser. No. 632,006, filed Nov. 14, 1975, now abandoned.

BACKGROUND OF THE INVENTION

This invention relates to snap action switch blades.

Many different types of snap action switch blade are known, particularly for use in thermostatic switches. The switch blade is acted upon at one point by a movable operating member associated, for example, with a temperature responsive element such as a fluid-filled bellows or diaphragm or a bimetal element, the switch blade being prestressed so that when the operating member has made a predetermined movement the blade deforms with a snap action from one configuration to another, causing rapid movement of a switch contact attached to a part of the blade remote from the operating member. The prestressing of such a switch blade is normally effected by a separate spring element acting upon the blade or by a special construction of the blade itself. This generally necessitates at least two component parts.

An object of the present invention is to provide a simple construction of inherently prestressed snap action switch blade which is of simple manufacture and which is versatile in its practical applications.

SUMMARY OF THE INVENTION

According to the invention there is provided a snap action switch blade comprising a dished loop of resilient sheet material closed at one end by a base portion from which two integral arms project to form the sides of the loop, two tongues projecting respectively into and out of the loop from the base portion, and a bridge portion drawing together the ends of the two arms remote from the base portion to close the loop and prestress the blade so that it can effect snap movement between at least two different configurations in which the arms are in different planes.

The construction of the snap action switch blade according to the present invention lends itself particularly to the installation of the switch blade in thermostatic switches, since the internal and external tongues of the blade are relatively stress-free regions. Consequently the configuration and shaping of the tongues can be chosen to suit a particular installation without substantially affecting the snap-action characteristics of the blade.

The bridge portion which draws the two arms of the switch blade together may be formed integrally with the remainder of the blade by pressing or stamping the entire blade in a single piece from a flat sheet of metal, the prestressing being achieved, either in the same or a subsequent pressing or stamping operation, by forming at least one kink in the bridge portion so as to draw the ends of the resilient arms together.

It may be preferred for manufacturing purposes to provide a separate bridge portion which is welded or otherwise joined to the ends of the two arms while the arms are drawn together so as to effect the prestressing of the blade.

The sheet metal loop forming the switch blade may be of any suitable spring metal, for example beryllium-copper. For some temperature responsive thermostatic switch applications the sheet metal loop may be formed of bimetal material.

In use of the switch blade a contact would be affixed to a part of the switch blade which effects snap-movement when the blade changes from one configuration to another. For example this contact may be supported by the bridge portion or may in fact constitute the bridge portion itself, one of the tongues being anchored in use of the blade. The other tongue may in this case be arranged for displacement by a movable operating member, for example in response to movement of a bellows or diaphragm.

In switch units where the two arms of the switch blade undergo symmetrical flexing upon snap movement of the blade from one configuration to another the contact would be located on or form part of the bridge portion and be disposed on the longitudinal axis of symmetry of the blade passing through the two tongues.

In other practical applications it may be found preferable to use an asymmetric configuration of the switch blade, in which a contact is carried by one of the arms or at one end of the bridge portion, displaced from the longitudinal axis of symmetry of the blade.

BRIEF DESCRIPTION OF THE DRAWINGS

The invention will be further described, by way of example, with reference to the accompanying purely diagrammatic drawings, in which.

The same reference numerals are used throughout the drawings to designate corresponding parts of the illustrated embodiments.

DETAILED DESCRIPTION OF THE ILLUSTRATED EMBODIMENTS

Figure 1:
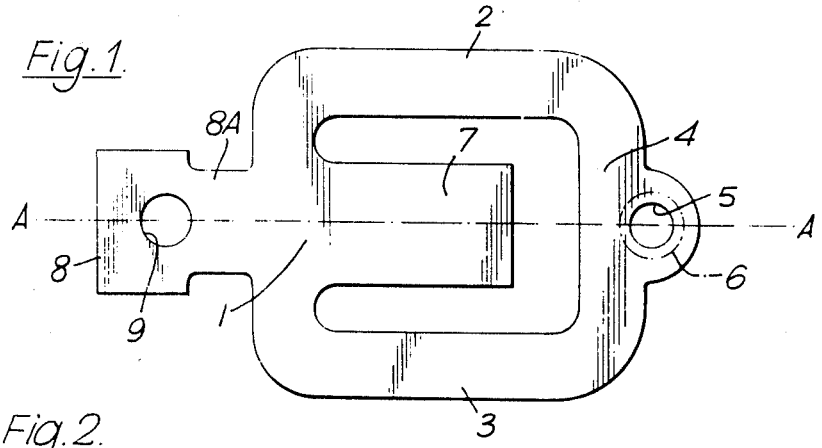
FIG. 1 is a plan view of a metal stamping used to form a switch blade according to one embodiment of the invention.

The blade in the embodiment of the invention illustrated in FIGS. 1 to 4 is made by stamping from a single piece of resilient sheet metal, in this example half-hardened beryllium-copper sheet of 0.01 inch thickness. The stamping, shown in plan in FIG. 1, is in the form of a flat loop closed at one end by a base portion 1 from which two parallel arms 2, 3 extend. In this embodiment the ends of the two arms 2, 3 remote from the base portion 1 are interconnected by an integrally formed bridge portion 4 forming the other closed end of the loop. Upon stamping of the sheet metal blank shown in FIG. 1 a hole 5 is punched in the bridge portion 4. The hole 5 is adapted to receive a switch contact 6 (FIG. 2) which is secured in the hole 5 by, for example, rivetting or welding.

The switch contact 6 may in practice be formed as an integral part of the bridge portion 4.

The base portion 1 of the flat loop is formed with two flat tongues 7, 8 projecting respectively into and out of the loop from the base portion. The outwardly projecting tongue 8 in this embodiment is formed with a neck portion 8*a* of reduced width and terminates at its free end in an enlarged portion having a hole 9 adapted to receive a fixing screw or pin for anchoring the tongue 8 at a fixed position in one mode of use of the switch blade.

Figure 2:
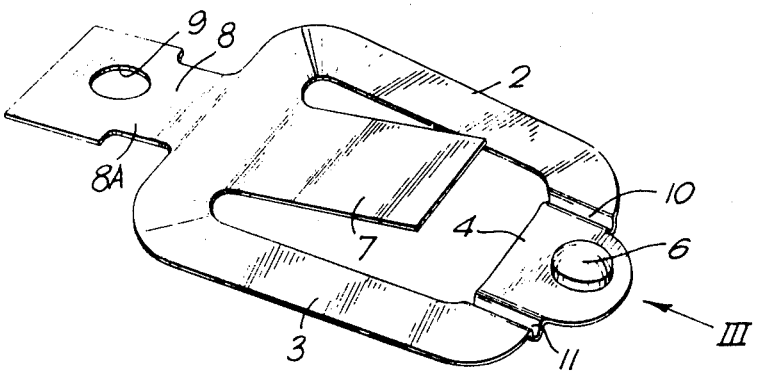
FIG. 2 is a perspective view of a switch blade formed from the stamping of FIG. 1.

After stamping the flat element from a sheet metal blank, as illustrated in FIG. 1 the ends of the resilient arms 2, 3 remote from the base portion 1 are drawn together by the formation of kinks 10, 11 in the bridge portion 4 symmetrically on either side of the contact receiving hole 5. By drawing the ends of the arms 2, 3 together in this way the base portion 1 is prestressed and 'dished' so that the switch blade adopts one of two stable positions. One of these stable positions is illustrated in FIG. 2. In both these stable positions the resilient arms 2, 3 are at all times coplanar but inclined in the opposite direction to the flat tongue 7 with respect to the initial plane of the stamped sheet metal element.

In one mode of use of the switch blade in the symmetrical configuration the outwardly projecting tongue 8 is anchored at a point on the longitudinal axis of symmetry A—A of the spring blade and the contact 6 carried by the bridge portion 4 is also disposed in this plane of symmetry. The two extreme configurations of the switch blade are then as illustrated diagrammatically in FIG. 3, with the bridge portion 4 remaining substantially parallel to the transverse axis of the base portion 1.

The resilient arms 2, 3 make snap movements between these two extreme configurations in response to movement of the inner tongue 7 in the opposite direction to the arms 2, 3. In this mode of operation, therefore, the tongue 7 may be acted upon by a switch operating member, indicated diagrammatically at 12 in FIG. 3, and associated for example, with a temperature responsive bellows or diaphragm or with a bimetal bender element.

When the movement of the inner tongue 7 by the operating member 12 is such as to cause the blade to enter a position of instability, snap movement of the contact 6 will occur as the switch blade changes its configuration, bringing the contact 6 into engagement with a fixed switch contact (not shown). When the tongue 7 is allowed to return to its original position (FIGS. 2 and 3A) the switch blade again makes a snap change in configuration, causing snap movement of the contact 6 away from the fixed contact.

Figure 3A:
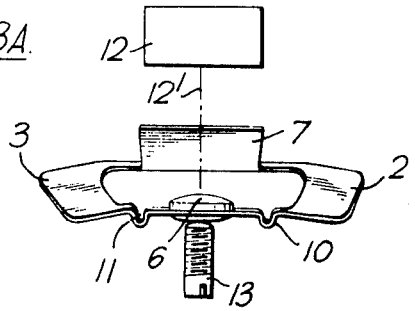
FIGS. 3*a* and 3*b* are diagrammatic end views in the direction of arrow III of FIG. 2 showing two extreme configurations of the switch blade in a symmetrical flexing mode of operation of the blade.
Figure 3B:
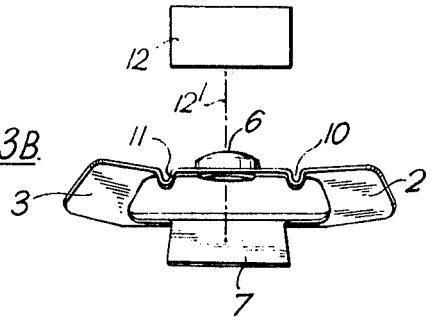

In the mode of operation of the switch blade illustrated in FIGS. 2 and 3 the switch contact and the fixed anchorage of the blade are symmetrically arranged on the longitudinal axis of symmetry A—A and the two resilient arms 2, 3 of the switch blade effect equal flexing movements. Presetting of the snap-movement of the switch blade from one extreme configuration (FIG. 3A) to the other extreme configuration (FIG. 3B) can be affected by adjusting the gap between the fixed contact and the movable contact 6 by means of a differential setting screw or cam (not shown), when the switch contacts are separated, with the switch blade in the configuration shown in FIG. 3A.

By suitably arranging the anchorage point of the switch blade relative to the position of the contact 6, and by limiting the deflection of the inner tongue 7, for example by means of a setting screw or cam, it is possible to arrange that the switch blade has a monostable or a bistable mode of operation, as desired. For example, if the inner tongue 7 is free to move between two stable extreme positions, as shown in FIGS. 3A and 3B, the switch blade is bistable and it is necessary to exert an operating force on the tongue 7 in one direction to effect changeover from the configuration shown in FIG. 3A to that shown in FIG. 3B and to exert an operating force in the tongue 7 in the opposite direction to effect changeover from the configuration shown in FIG. 3B to that shown in FIG. 3A. For this purpose the switch operating number 12 may be arranged to act on the tongue 7 through a suitable lost motion linkage 12'. On the other hand, if, in one of the extreme positions of the tongue 7 (FIG. 3B) the tongue 7 is deflected from a stable position so as to exert a resilient force against the operating member 12 towards the other extreme position (FIG. 3A) the switch blade is in effect monostable, in that when the tongue 7 is released from engagement with the operating member 12 it will always revert to one stable configuration, in this example, the configuration shown in FIG. 3A.

Figure 4:
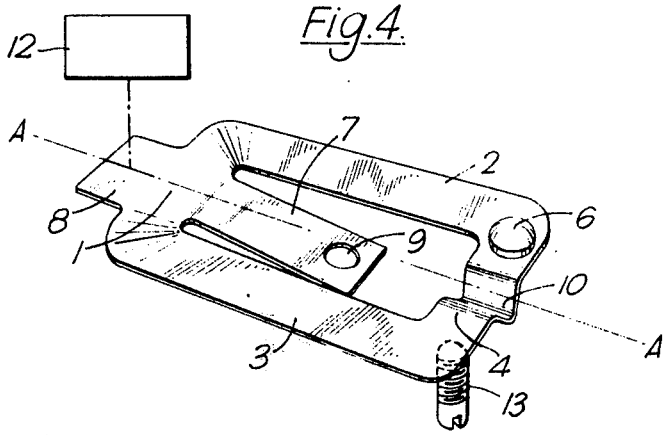
FIG. 4 is a diagrammatic perspective view, similar to FIG. 2, of an asymmetric switch blade according to a further embodiment of the invention.

An alternative embodiment of the switch blade according to the invention is illustrated diagrammatically in FIG. 4. This switch blade is similar to that shown in FIGS. 2 and 3, although the bridge portion 4 in this embodiment is formed with a single deforming kink 10. The switch contact 6 is located at one end of one of the resilient arms 2, or at one end of the bridge portion 4, spaced from the longitudinal axis of symmetry A—A of the blade.

This asymmetric configuration of the switch blade is also useful where a very small operating movement of a temperature responsive element has to be exploited to effect a switching operation, for example when the temperature responsive element is a liquid filled expansible bellows unit. In this case the switch operating member 12 would act at any suitable point on the longitudinal centerline of the switch blade, either directly, in the case of a monostable blade, or through a suitable lost motion linkage in the case of a bistable blade. In this example the switch operating member 12 acts directly on the outwardly projecting tongue 8, the blade being anchored at the end of the inwardly projecting tongue 7.

The blade of FIG. 4 could alternatively be anchored by means of its outwardly projecting tongue 8 and operated by an operating member acting on its inwardly projecting tongue 7, as in the embodiment of FIG. 2.

Setting of the switch blade could, for example, be effected by a setting screw or cam 13 acting at the end of the bridge portion 4 remote from the contact 6, to predetermine the amount of movement of the switch operating member necessary to operate the switch blade.

Figure 5:
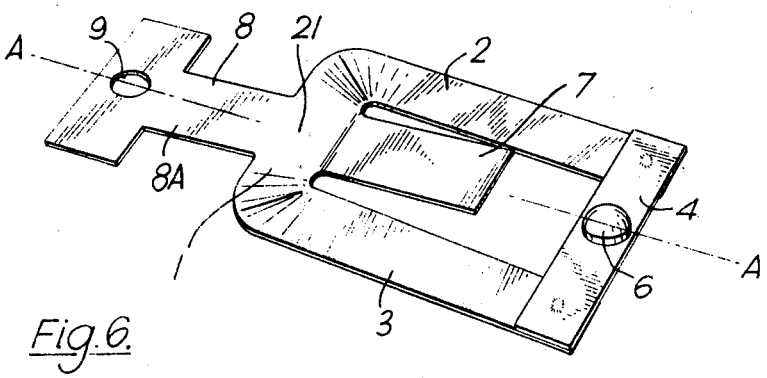
FIG. 5 is a perspective view similar to FIG. 2 illustrating a switch blade according to another embodiment of the invention.

The snap action switch blade in the alternative embodiment of the invention illustrated in FIG. 5 is made by stamping or pressing from a sheet of resilient sheet metal, for example half-hardened beryllium-copper sheet of 0.01 inch thickness. The stamping is in the form of a flat strip 21 having two resilient arms 2, 3 projecting therefrom and integral therewith, defining a base portion 1 of a loop formed by the arms. The arms 2, 3 project from the strip 21 intermediate the ends of the latter, and the ends of the arms 2, 3 project beyond a tongue 7 at one end of the strip 21, being interconnected by a bridge portion 4 welded to the ends of the arms 2, 3 remote from the base portion 1 and closing the loop formed by the arms 2, 3. The bridge portion 4 is formed with or constituted by a switch contact 6 which may be an integral part of the bridge portion 4 or which may be secured to the bridge portion 4 by, for example, revetting or welding. The contact 6 may be located in the center of the bridge portion 4, as shown in FIG. 5, or may be located at one end of the bridge portion 4 to form a switch blade analogous to the embodiment illustrated in FIG. 4.

An outwardly projecting tongue 8 at the end of the strip 21 remote from the bridge portion 4 is formed with a hole 9 or other means adapted to receive a fixing screw or rivet for anchoring the tongue 8 at a fixed position in use of the switch blade.

After stamping the strip 21 and the arms 2, 3 preferably from a continuous metal strip, the ends of the arms 2, 3 are drawn together and the bridge portion 4 is welded to the ends of the arms 2, 3, thereby stressing the arms 2, 3. This distorts the strip 21 and the arms 2, 3 into a dished shape so that it can adopt one of two stable positions, one of which is illustrated in FIG. 5, in which the resilient arms 2, 3 are substantially parallel to each other but inclined to the strip 21.

The construction of the switch blade according to the invention affords considerable versatility in the way in which the switch blade is installed for a snap switching action. Thus in the alternative mode of operation of the switch blade shown in FIG. 4 the fixed anchorage of the blade is located at the end of the inwardly projecting tongue 7 and the switch operating member 12 acts on the outwardly projecting tongue 8, or on the base portion 1, the switch operating movement of the tongue 8 being in this case in the same direction as the resulting movement of the contact 6.

The switch blade according to the invention can easily be installed in a switch housing so that setting means for predetermining the movement of the operating member necessary to operate the switch, which, in the case of a temperature responsive switch, represents the temperature differential necessary to operate the switch, can be easily adjusted by an adjusting element such as, for example, a screw extending through the switch casing, without critical limitation on the position of this adjusting element.

Moreover, by suitable selection of the width of the neck portion 8A of the outwardly projecting tongue 8 it is possible to introduce a predetermined degree of flexibility into the lever arm by which the switch blade is connected to its fixed anchorage or to the point of action of the operating member. The length of the neck portion 8A determines the effective lever arm by which the switch blade is anchored or upon which the switch operating member acts. It is therefore possible, by suitable dimensioning of the neck portion 8A to achive a desired operating force for the switch blade substantially independent of the force differential associated with the changeover of the switch blade from one configuration to another, which is a result of the prestressing of the arms 2 and 3.

Figure 6:
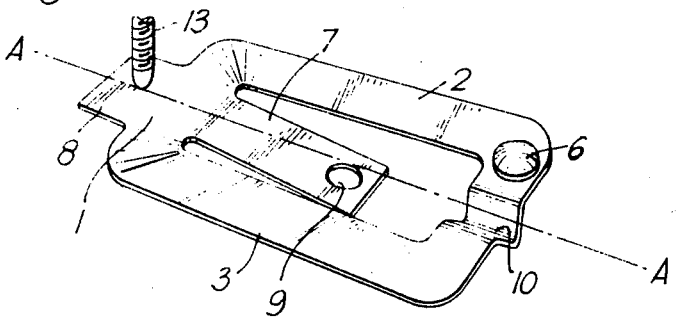
FIG. 6 is a perspective view similar to FIG. 4 illustrating a switch blade according to a further alternative embodiment of the invention.

FIG. 6 illustrates a further embodiment of the invention in which the entire switch blade is made of bimetal sheet material. The illustrated bimetal blade is similar to that shown in FIG. 4, but in principle the blades illustrated in FIGS. 2 and 5 could also be fabricated in bimetal. By forming the blade of bimetal it can be arranged that a snap transition in the configuration of the blade takes place at a given temperature due to thermally induced flexural stresses in the blade, and the necessity for a separate switch operating member is avoided.

In the embodiment illustrated in FIG. 6 the blade is anchored at the end of the inner tongue 7, and has a monostable mode of operation, with a setting cam or screw 13 acting at a convenient point on the blade, for example on the outer tongue 6, to predetermine the configuration of the switch blade under ambient temperature conditions. Alternatively, the blade of FIG. 6 could, of course be anchored at the end of the outer tongue 8, in which case the inner tongue 7 could be arranged to cooperate with a presetting cam or screw.

We claim:

1. A snap action switch element comprising a dished blade of resilient sheet material having a base portion, two arms projecting from said base portion, a resiliently flexible internal tongue integral with the base portion and disposed between the arms, a resiliently flexible external tongue integral with the base portion and extending from the latter in the opposite directon to the internal tongue, and a bridge portion drawing together the ends of the two arms remote from the base portion of the blade, the bridge portion prestressing the blade and predisposing it for snap movement between two different configurations upon displacement relative to the arms of the end of one of said tongues, the other of said tongues having an end section constructed for anchoring to a support, at least one of said internal and external tongues resiliently deflecting upon displacement of said end of said one tongue and predetermining the force to be applied to said one tongue to effect said snap movement.

2. The switch element defined in claim 1, wherein the blade is formed of resilient sheet metal.

3. The switch element defined in claim 1, wherein the blade is formed of bimetal material.

4. The switch element defined in claim 1 and further including a switch contact surface carried by the bridge portion.

5. The switch element defined in claim 4, wherein said blade is symmetrical about a longitudinal plane passing through said tongues and the switch contact surface is disposed on the longitudinal axis of symmetry of the blade.

6. The switch element defined in claim 1, wherein said blade is symmetrical about a longitudinal plane passing through said tongues and further including a switch contact carried at one end of the bridge portion, said contact displaced from the longitudinal axis of symmetry of the blade.

7. The switch element defined in claim 1, wherein the bridge portion is integral with the remainder of the blade, the prestressing of the blade resulting from at least one kink in said bridge portion.

8. The switch element defined in claim 1, wherein the bridge portion is formed by a member fixed to the ends of the two arms remote from the base portion, said bridge portion holding the said arms in drawn together positions so as to effect the prestressing of the blade.

9. The switch element defined in claim 8, wherein the bridge portion defines an electrical contact surface.

10. The switch element claimed in claim 1, wherein said external tongue is anchored to a support and said internal tongue coacts with a movable member which displaces said internal tongue to enable snap movement of said blade.

11. The switch element defined in claim 1, wherein the external tongue has a neck portion of reduced width adjoining the base portion of the blade.

* * * * *